US007328820B2

(12) United States Patent
Young

(10) Patent No.: US 7,328,820 B2
(45) Date of Patent: Feb. 12, 2008

(54) VENTED FLUID CLOSURE AND CONTAINER

(75) Inventor: John L. Young, 12425 Honolulu Ter., Whittier, CA (US) 90601

(73) Assignee: John L. Young, Whittier, CA (US)

( * ) Notice: Subject to any disclaimer, the term of this patent is extended or adjusted under 35 U.S.C. 154(b) by 7 days.

(21) Appl. No.: 11/260,071

(22) Filed: Oct. 27, 2005

(65) Prior Publication Data

US 2006/0071040 A1 Apr. 6, 2006

Related U.S. Application Data

(63) Continuation-in-part of application No. 10/869,603, filed on Jun. 16, 2004, which is a continuation-in-part of application No. 10/267,306, filed on Oct. 9, 2002, now Pat. No. 6,779,694, which is a continuation-in-part of application No. 09/994,303, filed on Nov. 26, 2001, now abandoned, which is a continuation-in-part of application No. 09/736,350, filed on Dec. 14, 2000, now abandoned.

(51) Int. Cl.
*B67D 3/00* (2006.01)

(52) U.S. Cl. ..... 222/484; 222/481.5; 222/556; 222/562; 222/568; 215/235; 215/237; 215/307; 220/367.1; 220/717

(58) Field of Classification Search ..... 222/485–486, 222/481.5, 484, 479, 482, 553, 556, 562, 222/564, 558, 212; 215/229, 309, 367.1, 215/307, 235, 237; 220/367.1, 837, 839, 220/717

See application file for complete search history.

(56) References Cited

U.S. PATENT DOCUMENTS 1,596,773 A 5/1926 Spotz
1,977,302 A 10/1934 Brill
2,812,120 A * 11/1957 Beall, Jr. ..... 222/481.5
3,059,816 A * 10/1962 Goldstein ..... 222/109
3,369,718 A * 2/1968 Libit et al. ..... 222/481.5
3,655,102 A * 4/1972 Moran ..... 222/484
4,463,882 A 8/1984 Hammett
4,779,766 A * 10/1988 Kinsley ..... 222/153.06

(Continued)

FOREIGN PATENT DOCUMENTS

EP 0 621 200 A1 10/1994

*Primary Examiner*—Frederick C. Nicolas
(74) *Attorney, Agent, or Firm*—Jenner & Block

(57) ABSTRACT

A vented closure for a liquid container which will not freely pour includes a cap hinged at one side and movable between open and closed positions relative to a base collar. In an open position, a primary fluid passageway extends through a shaped mouthpiece which is elongated and tapered to conform to a user's mouth. One or more air vents of small size are located in a protected floor of the base collar at positions spaced within predetermined ranges of offsets from the dispensing opening so as to convey liquid into contact with the air vents in a manner to self-seal the air vents by surface tension of the liquid until an unbalance force is present. The cap and collar mate along an offset diagonal edge, and a grip area for the user's thumb or finger is offset from a center line. The offsets cause the cap to flip open with additional clearance and without obstructing a user's nose.

29 Claims, 5 Drawing Sheets

U.S. PATENT DOCUMENTS 4,782,985 A * 11/1988 Kinsley ..... 222/481.5
4,804,098 A 2/1989 Montgomery
4,838,441 A * 6/1989 Chernack ..... 215/216
5,141,138 A 8/1992 Odet
5,147,072 A * 9/1992 Dirksing ..... 222/212
5,328,058 A 7/1994 Leoncavallo
5,386,918 A 2/1995 Neveras
D374,399 S 10/1996 Neveras
5,865,353 A * 2/1999 Baudin ..... 222/546
5,897,013 A 4/1999 Manganiello
5,927,565 A 7/1999 Paczonay
5,988,448 A 11/1999 Foth
6,050,433 A 4/2000 Russell
6,079,586 A * 6/2000 Hanneman ..... 220/526
6,170,719 B1 * 1/2001 Wilkinson et al. ..... 222/479
6,196,413 B1 * 3/2001 Tung ..... 220/709
D440,495 S 4/2001 Sagel
6,679,403 B2 1/2004 Goodall
6,702,137 B1 3/2004 Kowa
6,832,706 B2 12/2004 Hearld
6,880,736 B1 4/2005 Gnepper

* cited by examiner

Fig 4
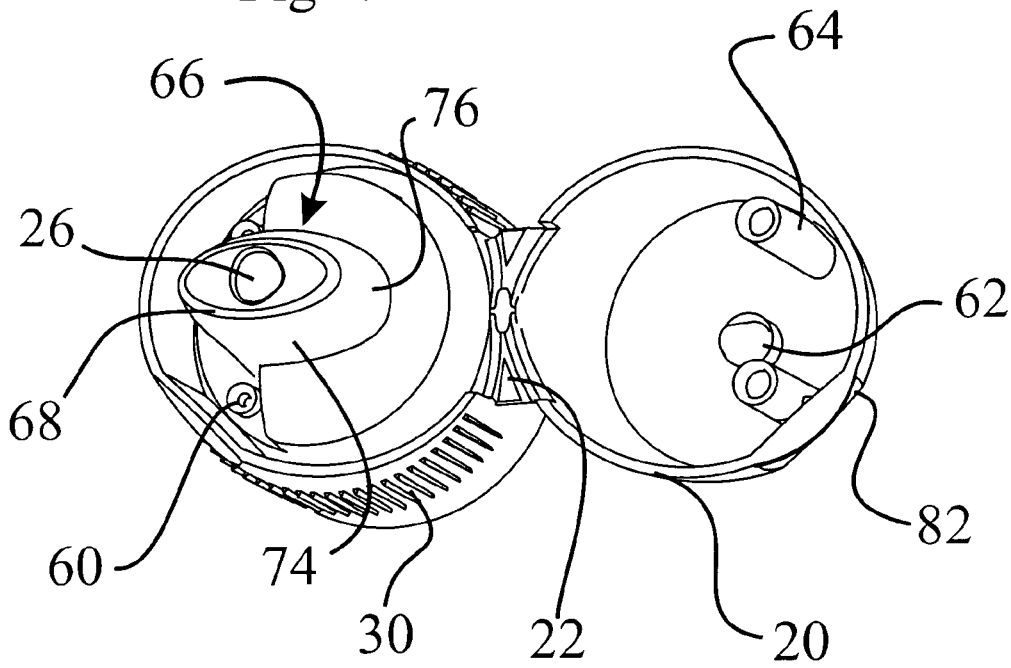
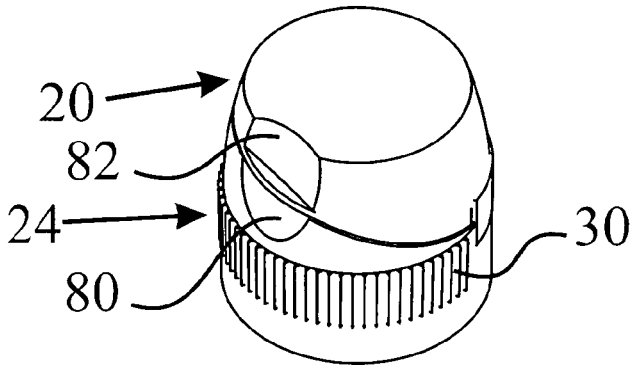
Fig 5
Fig 6
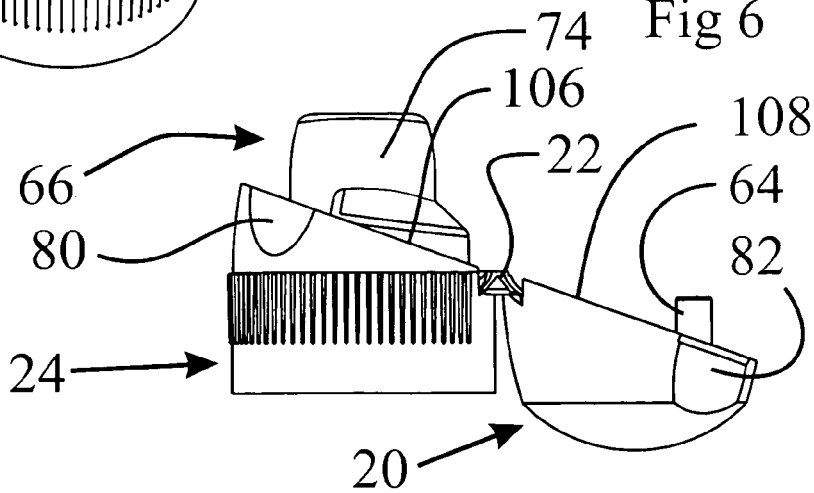

VENTED FLUID CLOSURE AND CONTAINER

CROSS-REFERENCE TO RELATED APPLICATIONS

This application is a continuation-in-part of my application Ser. No. 10/869,603, filed Jun. 16, 2004 entitled "Vented Fluid Closure and Container", which is a continuation-in-part of my application Ser. No. 10/267,306, filed Oct. 9, 2002, entitled "Vented Fluid Closure and Container", now U.S. Pat. No. 6,779,694, which is a continuation-in-part of my application Ser. No. 09/994,303, filed Nov. 26, 2001, entitled "Vented Fluid Container Closure", now abandoned, which is a continuation-in-part of my application Ser. No. 09/736,350, filed Dec. 13, 2000, entitled "Vented Fluid Container Closure", now abandoned.

FIELD OF THE INVENTION

The present invention relates generally to vented fluid closures and containers and, more particularly, to a vented closure for a fluid container with a non-pouring type fluid passage when the closure is open.

BACKGROUND OF THE INVENTION

Water and other non-carbonated beverages, and particularly sports drinks, are sold in individual servings in the form of deformable plastic bottles which are squeezable. Such bottles typically have a cap in the form of a pull open/push close type closure, or a flip to open cap, which typically provides a single fluid passage which is not vented. The lack of a vent in the closure causes the deformable container to collapse as a consumer draws a beverage from the container while drinking, due to a pressure differential that is created between the fluid and the exterior of the container, since the external pressure is higher as the exiting liquid causes the internal pressure to decrease. At some point during the drinking process, depending on the size of the container, no additional liquid can be withdrawn from the container until the pressure is equalized by stopping the drinking process and allowing air to rush in through the single fluid passage in the closure. This equalization can cause a reflux or backwash from the consumer's mouth into the container, which tends to contaminate the fluid in the container. Because of these problems, consumers frequently equalize pressure by holding the bottle away from the mouth and squeezing the deformable bottle in a series of squirts, with pressure equalization taking place between each squirt. This procedure often results in spills of the fluid, and results in the consumer drinking less than were it easier to dispense fluid.

Conventional fluid containers are sometimes vented, but the vent typically is part of the container itself, and not part of the closure. Vented closures intended for pouring are known, but are undesirable for use in non-pouring type closures in which fluid will not continuously pour out of the bottle when the bottle is tilted downwardly. Sports bottles are an example of a non-pouring type closure which are intended to be left open for quick drinks during an activity, and can be easily knocked over. In general, pouring type closures are not suitable for sports bottles and other deformable containers in which the liquid exits in spurts due to squeezing of the container and/or placing the user's mouth around the closure opening to draw liquid out of the container.

The manufacturing cost of closures used on sports drink containers and the like is critical. An increase of fractions of one cent can severely impact marketability by the closure manufacturer since consumers usually are focused on the sports beverage or supplier and are generally unwilling to pay more for the bottle and closure which contains the beverage. Likewise, it is very important that any closure should be compatible with existing bottling and assembly equipment and should be usable in connection with standard bottling and assembly processes. The types of closures proposed in the past have been incompatible with these requirements.

The choke hazard posed by relatively small parts and/or separable parts used for closures have caused concern. Small children have been endangered by chewing on closures until the parts became distorted and loose. This problem is particularly troublesome for pull to open and push to close type closures.

One solution to the choke hazard is to use hinged top closures which typically have larger size parts that are molded as one piece. However, these hinged closures can be difficult to open and orient for comfortable use. It is difficult on many hinged top closures to identify the latching area and/or for a user to apply force to the latch to open, because the machinery used to attach the closure to the bottle during filling and assembly requires that nothing protrude from the closure surface. Another concern with hinged top closures is the difficulty for many users to properly orient the closure for opening and use. It is natural for users to rotate the closure so the latch is facing them to facilitate pushing the closure open with the thumb. However, the open hinged cover then tends to align behind the thumb and opposite the consumer's nose when the container is raised to drink. This is an uncomfortable and undesirable condition.

One objective of the present invention is to provide an improved vented fluid container closure of the non-pouring type that is adaptable to a standard beverage container and which are easily adaptable to current beverage filling and processing equipment.

Another objective of the present invention is to provide an improved hinged top closure which allows for easy opening, comfortable use and reduced choke hazard.

A further objective is to provide structure which improves the venting operation, and the dispensing of liquid through a mouthpiece for convenient drinking from a container which can be repeatedly opened and closed.

SUMMARY OF THE INVENTION

In order to achieve the foregoing objectives, the present invention provide non-pouring type closures with a fluid passage and one or more vent passages of predetermined dimensions and placement in a base collar adaptable to a standard beverage container. The fluid passage and the one or more vent passages may be opened and closed by the same cap. When the cap is open and inverted to a drinking position, surface tension of the liquid will seal the one or more vent passages which are in contact with the liquid. The vent openings are sufficiently small in size and placed relative to the main fluid exit so that the weight of the liquid which is in direct contact with the vent openings does not exert sufficient force to overcome surface tension and substantially prevents equalizing air from entering the vent passageways.

When the container is squeezed or the user draws liquid through the mouthpiece, air bubbles enter a vent passageway separated from the flow of exiting liquid by a divider which prevents the air bubbles from becoming entrained. Structure is included to reduce bubble size and noise and improve the venting operation.

An improved hinged type closure includes a flip cap having an orientation relative to an elongated mouthpiece and a structure so as to better orient the closure for use. The cap will open to a side and away from possible interfering positions with the user's face. The mouthpiece has a shape and structure to improve drinking from the closure and reduce spills or leakage. Supplemental stoppers and plugs also prevent leakage due to sudden forces such as can occur, for example, during transport of a pre-filled liquid container.

BRIEF DESCRIPTION OF THE DRAWINGS

FIG. 4 is an enlarged perspective view of the closure with the flip cap being shown in an open position:

FIG. 5 is a perspective view of the closure with the flip cap being shown in a closed position;

FIG. 6 is a side view of the closure with the flip cap being shown in its fully open position;

DETAILED DESCRIPTION OF THE PREFERRED EMBODIMENT

Figure 1:
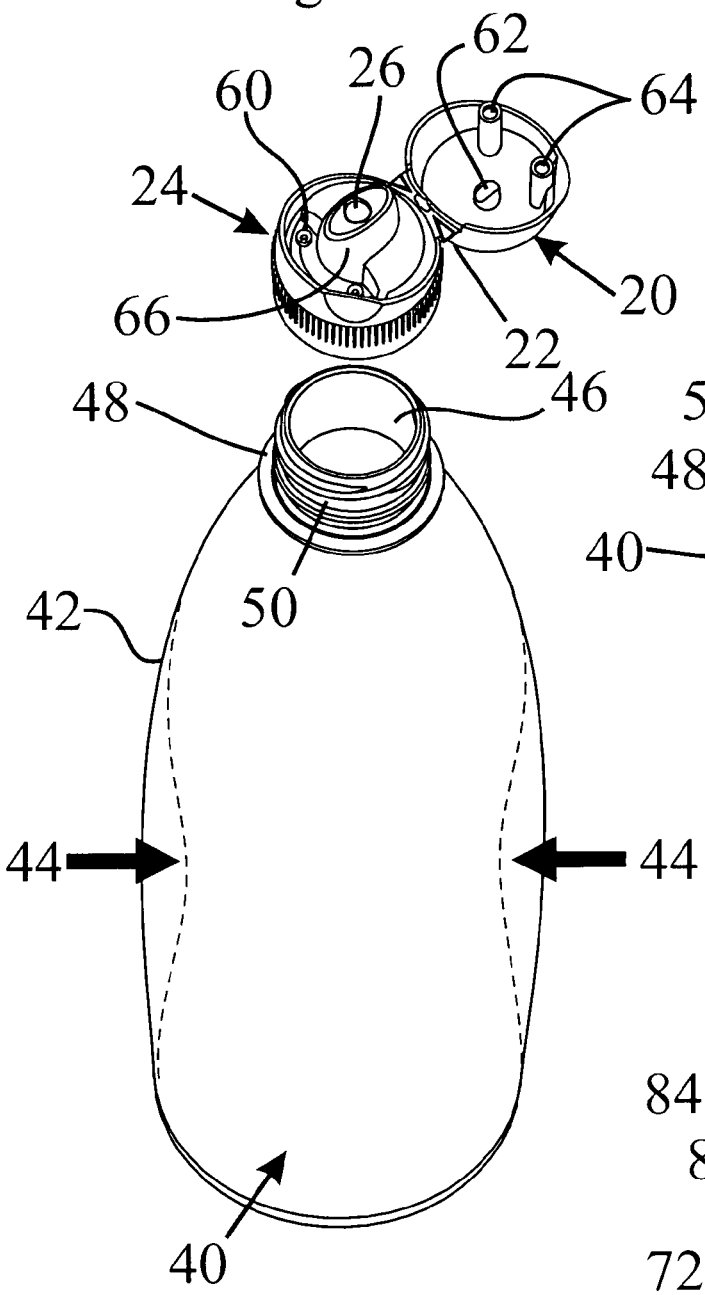
FIG. 1 is a top perspective view of a novel vented closure attachable to a deformable beverage container and having its hinged cap flipped to an open position.
Figure 2:
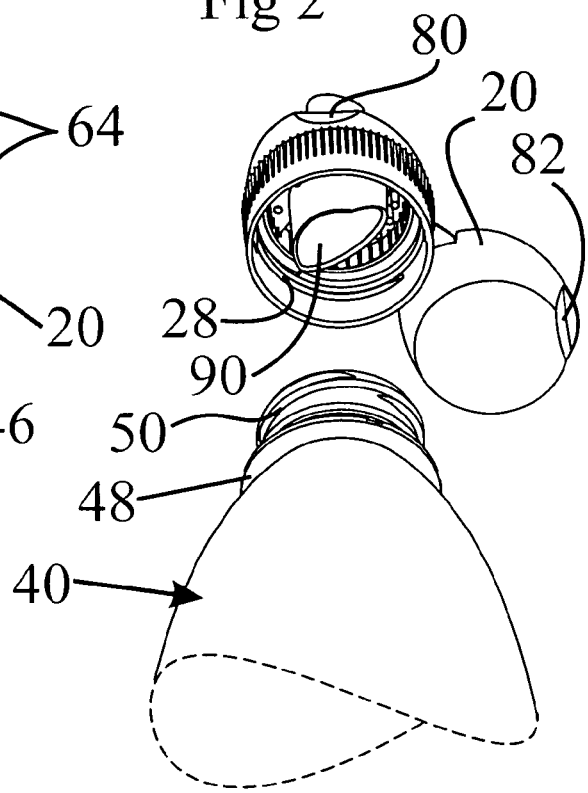
FIG. 2 is a bottom perspective view of the embodiment of FIG. 1.

As seen in FIGS. 1 to 8, a novel vented fluid closure is molded as one piece and includes a top cover or cap 20 which is movably connected by a hinge 22 to a base collar 24 having a central liquid dispensing bore or outlet opening 26. The cap 20 is movable between open positions for dispensing liquid and a closed position as seen in FIG. 5. The collar includes interior threads 28 for mating engagement with a beverage container. An exterior annual wall of the collar 24 includes a large plurality of vertical ribs or splines 30 which are engagable by standard packaging machinery to provide gripping surfaces to assist in threading the interior threads 28 onto the beverage container after the container has been filled during the manufacturing process. These external ribs 30 also assist the user in attaching or detaching the closure from the container.

The base collar 24 and the cap 20 are adapted to mate with a standard fluid container 40 which may be any container for containing a fluid, such as a plastic bottle for a single serving of a liquid sport drink or water. The beverage container 40 preferably has thin plastic side walls 42 which are squeezable or deformable along arrows 44 in order to increase pressure within the closed container when liquid is to be dispensed from the container. The container 40 forms a closed vessel having deformable side walls, a bottom wall, and a top section having an upright annular neck 46 which is hollow and serves as the sole opening for the passage of fluid out of the container.

The upright annular neck 46 includes an annular rib 48, and located above the rib 48 are external threads 50 for mating engagement with the internal threads 28 of the base collar 24. Preferably the cap 20 and base collar 24 are molded as a single piece connected by a living hinge 22. They can be formed of a high density polyethylene (HDPE) or polypropylene (PPL), but any suitable material may be used. It is possible, but less desirable due to a choke hazard, to mold the cap 20 and collar 24 as separate pieces which can be rotatably connected to each other.

One or more small diameter vent apertures 60 are located in the collar 24, see FIGS. 1 and 4. Each vent aperture 60 is of a small cross-sectional area and is at a location selected to perform self-sealing by surface tension of liquid in contact with the aperture 60. Namely, the cross-sectional area and the location of the vent aperture 60 relative to the fluid dispensing opening 26 are selected, as will be explained in connection with FIGS. 9 and 10, to create a self-sealing feature. More than one vent aperture 60 is useful to increase venting air flow into the container and to prevent possible clogging due to dust or small debris, and two vent apertures are illustrated by way of example.

Figure 7:
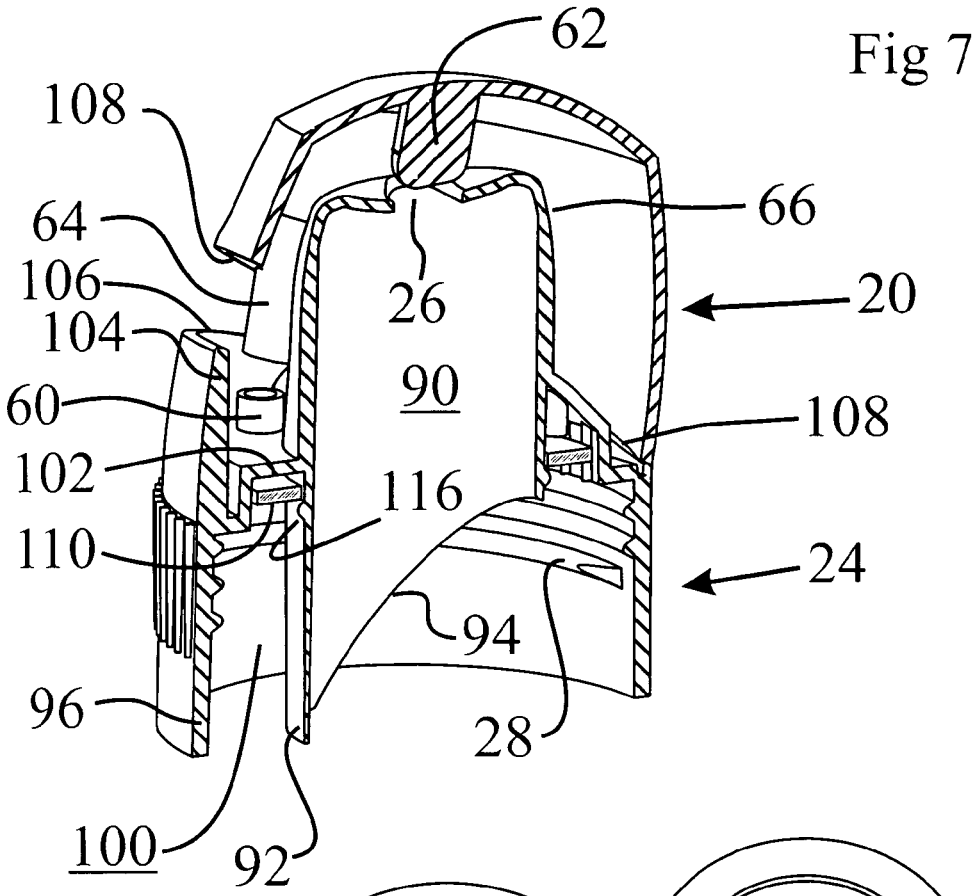
FIG. 7 is a side cutaway view of the closure with the flip cap being slightly opened.

The cap 20 includes a central stopper plug 62 which inserts snuggly into and blocks the liquid bore 26 when the cap is rotated to a closed position, see FIG. 7 which illustrates the cap 20 slightly open. The cap 20 also includes two vent plugs 64 which extend over and mate with the vents 60 to form a block for each vent 60 when the cap 20 is fully closed. As will be explained, the vent apertures 60 will self-seal and the main liquid opening 26 will not leak during normal use until the container 40 is squeezed or some other unbalance force causes a loss of equilibrium. Such forces can be present in the process of transporting a pre-filled liquid container, and therefore the stoppers 62 and 64 are advantageous to supplement the self-sealing function. Also, the cap 20 which entirely covers all closure openings, and the positive stoppers for the fluid dispensing and venting, assist in preventing tampering and intentional or accidental contamination of the liquid in the container prior to purchase and individual use by a consumer.

The liquid dispensing opening 26 is located on the top of an elongated and tapered upright mouthpiece 66, seen best in FIGS. 1, 3, 4 and 6, which is generally oval in shape at the top. The mouthpiece extends upwardly to a flattened peak having an elliptical top 68 with a major axis 70, see FIG. 3, which intersects the circular opening 26 at the center of the top and also intersects the middle of the hinge 22. The side mounted hinge 22 is coaxial with, and the cap 20 is movable about, a transverse axis 72 which is normal with the major axis 70, i.e. is at a 90 degree angle. Extending downwardly from the elliptical top and located on opposite sides of the major axis 70 are wide and generally planar sides 74 which are adapted to contact the upper and lower lips of a user when drinking from the closure. A pair of narrow and arcuate sides 76 connect the wide sides 74. The sides 74 and 76 taper towards the oval top rim 68. The upright, elongated and shaped mouthpiece 66 is adapted to receive the user's mouth so that the user's lips on the wide sides 74 will generally seal the dispensing opening and prevent spills. The generally oval shape also provides tactile orientation and feedback to a user to better orient the mouthpiece within the user's lips during use.

It is also desirable to orient the cap 20 to open in a manner to avoid interference with the user's face during use. The hinge 22 is to the side of the main lip contacting surfaces 74 and intersects the elongated main axis 70. As a result, the cap 20 when flipped open as seen in FIGS. 4 and 6 will be located away from and to a side of the user's nose, when the user's upper and lower lips are placed on the wide sides 74 of the shaped mouthpiece 66.

To assist the user in flipping open the cap 20 by one hand operation, the base collar 24 has a thumb or finger grip recess 80 which forms a shallow depression or recess in the annular collar 24, see particularly FIGS. 5 and 6. A corresponding guide recess or indented surface 82 form shallow depression in the cap 20 and is aligned with and located above the thumb recess 80. The aligned thumb recess 80 and guide recess 82 provide a visual indicator of where the user should place his or her thumb or finger on the closed cap in order to flip the cap upwardly to open the closure. The relieved surfaces 80 and 82 provide a convenient area for a user to push against and open the cap by a one hand operation while avoiding grip tabs or extensions which would protrude beyond the circular periphery of the collar. Standard capping equipment requires closures to be round when viewed from above, with no elements such as hinges or tabs or grips protruding from the periphery of the collar 24.

Figure 3:
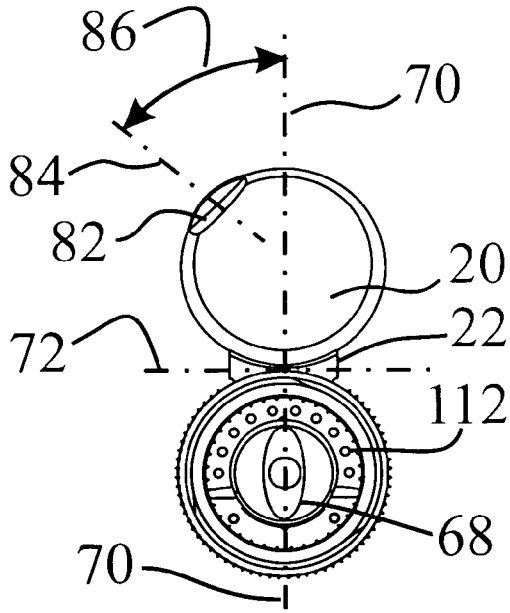
FIG. 3 is a bottom view of the vented closure shown in FIGS. 1 and 2, with a barrier ring being omitted to illustrate certain mounting structure.

Desirably, the thumb or finger recesses 80 and 82 are offset from the major axis 70 of the elongated mouthpiece 66 and are located along a skewed axis 84, see FIG. 3, which is at an acute angle 86 with respect to the major axis 70. The acute angle should be at least 10 degrees and well less than 90 degrees, and preferably can be from 30 to 60 degrees. This offset is more desirable than providing a thumb recess 80 and guide recess 82 located on the major axis 70, because users often will open the closure with their thumb while holding the closure directly in front of their face. As a result, a centrally located thumb recess would cause the cap 20 to flip directly backward so that the cap would be opposite the user's face and nose. By angling the recesses along an offset axis 84, the cap 20 when flipped open is at an offset angle to the user's nose. This helps the user to correctly place his or her lips on the planar mouthpiece sides 74, which also causes the opened cap 20 to be located properly to either side of the person's nose. While the offset axis 84 could be greater than illustrated in FIG. 3, too great an offset (such as 90 degrees) will place too much stress on the hinge 22. Thus, the offset skewed angle 86 is a compromise to assist in orienting the cap to one side yet not staining the hinge too much with repeated openings.

The closure can include, if desired, a latch tab (not illustrated) on the cap 20 which mates with a stop or lock surface on the base closure 24 to prevent tampering prior to purchase. The latch and lock can be formed as a part of the recess surfaces 80 and 82.

The mouthpiece 66 is hollow and forms a primary fluid passageway 90, see FIG. 7, which extends from the interior of the bottle 40 to the primary fluid dispensing aperture 26. The bottom of the passageway 90 is formed by a divider baffle 92 having a skewed diagonal bottom edge 94 which angles from its lowest portion, adjacent the vent apertures 60, to its highest portion adjacent the rear of the closure near the hinge 22 and hence furthest away from the vent apertures 60. The collar 24 has an annular bottom wall 96 which forms the interior threads 28 for screwing the collar onto the container. The space between the divider baffle 92 and the collar bottom wall 96 forms a secondary fluid passageway 100 which conveys liquid from the container directly to the small diameter vent apertures 60 and passes venting air from the apertures 60 through the secondary passageway 100 and into the container. The divider baffle 92 forms an interior tube which surrounds the central fluid passageway 90, and desirably extends into the container to its maximum length adjacent the vents 60 so as to better separate the air bubbles which flow through the vents 60 and into the container from the liquid being dispensed through the primary passageway 90. The substantially open diagonal end 94 allows for a larger opening to the primary fluid passageway 90, which reduces the velocity of the exiting liquid as it passes the baffle tube and thereby reduces entrainment of venting air into the liquid being dispensed.

Figure 8:
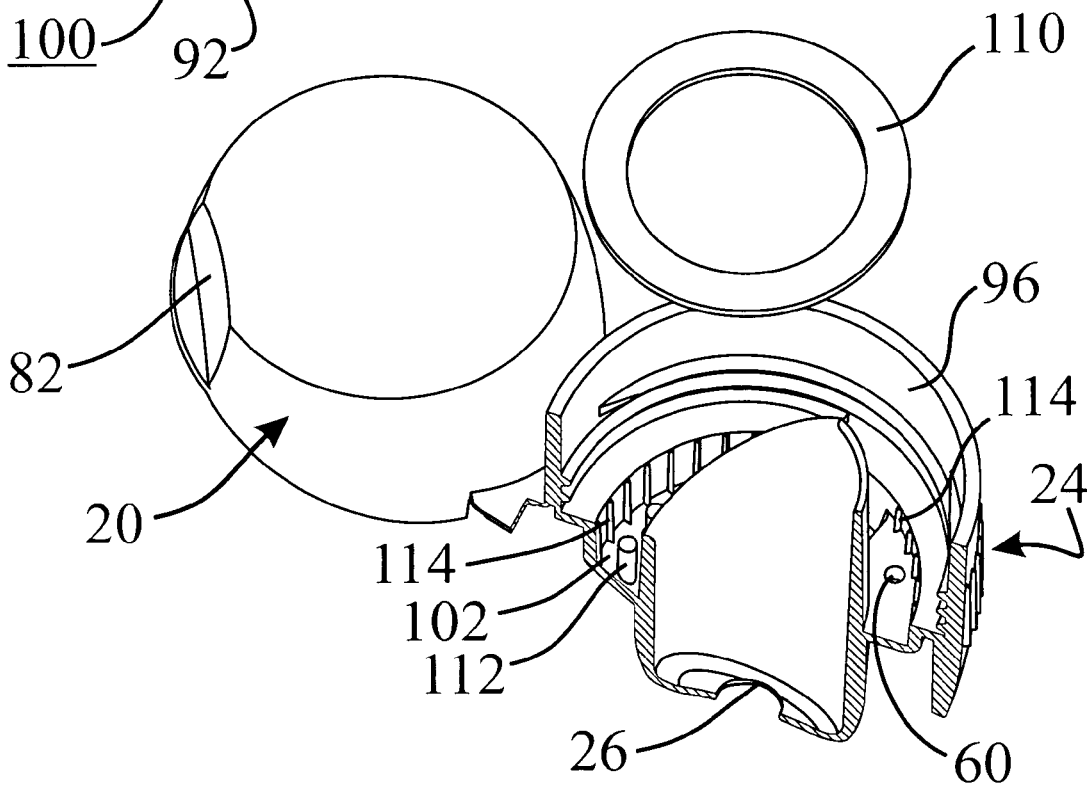
FIG. 8 is a bottom view, partly in section and partly exploded, of the closure with the flip cap being opened.

The vent apertures 60 are located on and extend through a horizontal floor or shelf 102, see FIGS. 7 and 8, located at an intermediate position between the main opening 26 at the top of the mouthpiece 66 and the bottom of the closure. One vent aperture 60 is adjacent and to one side of the mouthpiece main axis 70 and the other vent aperture 60 is adjacent and to the other side of the mouthpiece main axis 70, and both vent apertures are away from the hinge side. The base collar 24 includes an upper arcuate wall or skirt 104 which extends upwardly with the top edge being located above the vents 60, so that the floor shelf 102 is recessed below the collar upper edge 104. The curved extending skirt 104 forms a protective barrier and a channel for air passing into the vents 60, and prevents the user's lips when contacting the mouthpiece from resting on and/or blocking the vent apertures 60.

The base collar has a diagonal or skewed arcuate top edge 106, see FIG. 6, which slopes downwardly towards the hinge 22. Similarly, the cap 20 has a arcuate bottom edge 108 extending along a diagonal slope which abuts the top edge 106 of the collar to seal the base collar 24 when closed and thus protect the liquid contents of the container from external contamination. The bias or diagonal line of parting at edges 106 and 108, with the lowest point being adjacent the side hinge 22, increases clearance of the cap with the user's face as compared with generally horizontal edges for the cap and collar, or a higher point adjacent the hinge, as is standard in many hinged closures. That is, the height of the collar wall is higher adjacent the vents 60, and lower adjacent the hinge 22, so the cap 20 can be flipped further away from the peak of the mouthpiece 66. Desirably as seen in FIG. 6, the fully open cap 20 moves to a position which extends partly below the bottom of the collar 24, and thus further increases clearance away from the top of the mouthpiece 74. If desired, a safety seal (not illustrated) can encircle the cap 20 and collar 24 to protect the contents of a pre-filled beverage container 40 prior to purchase and initial use by a consumer.

The secondary fluid passageway 100 desirably includes structure to form a serpentine or turbulent pathway for the venting air entering the vents 60. As seen in FIGS. 7 and 8, the secondary fluid passageway 100 is desirably formed asymmetrically to one side of the collar and away from the central main fluid passageway 90. A barrier ring 110 is located in the direct path between the vents 60 and the secondary passageway 100. The ring 110 is floating and is captured between a plurality of posts 112 which extend from the floor shelf 102, and a rib 116 on the collar 24. The edge of the floating ring 110 abuts a plurality of ribs 114 formed on a side wall extending from the floor 102. The ring 110 is sized to allow venting air bubbles to be diverted to the side and around the ring and through the plurality of channels formed between the ribs 114 and then back into the secondary fluid passageway 100. The ring 110 can be made of a semi-rigid material such as low density polyethylene, and can float within a narrow range of vertical movements between the posts 112 and a capturing rib 116 formed from a protrusion in the tube wall forming the divider baffle 92. The resulting serpentine or wavy path around the ring 110 assists in minimizing the size of air bubbles flowing through the vents 60 and into the secondary passageway 100. The smaller air bubbles which result help to reduce undesirable bubbling noise as the user tilts the container and draws liquid out the main bore 26 in order to dispense the liquid. Thus, the secondary fluid passageway 100 desirably has a wavy or circuitous path for venting air, or otherwise creates a non-straight path for venting air which is forced to travel at a substantial angle to the otherwise longitudinal flow of liquid through the primary fluid passageway 90 in order to quiet the sound of air bubbles entering the container when titled to dispense liquid. The use of multiple vent apertures 60, each of small size, also assists in producing small air bubbles in the secondary fluid passageway 100.

Figure 9:
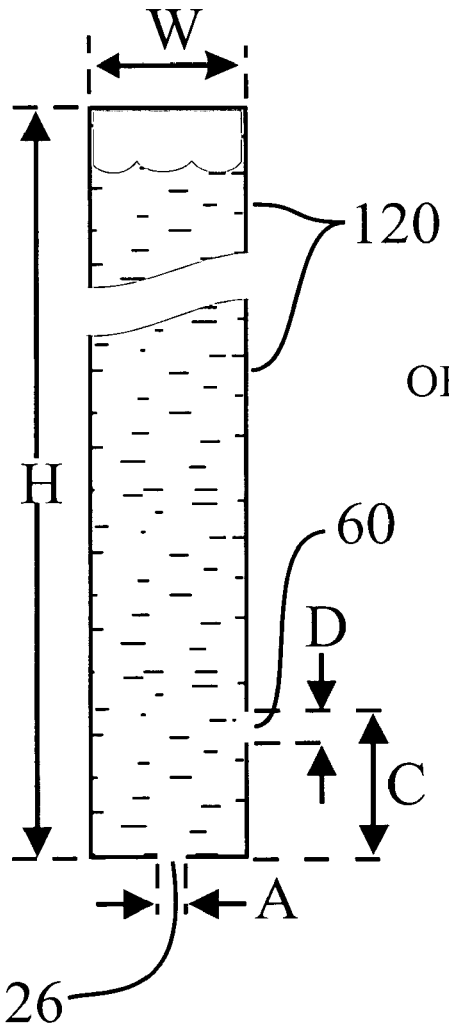
FIG. 9 illustrates test apparatus for determining the size and locations of the vent apertures relative to the liquid dispensing aperture.

FIG. 9 shows test apparatus used to determine the relationships regarding one or more of the vent apertures 60 and the main fluid dispersing opening 26, labeled A in the test apparatus. A tubular container 120 of PVC plastic having rigid sides was constructed of a height H and an internal diameter W, and was sealed at both ends. A liquid dispensing bore 26 was drilled of various diameters A. One or more vent apertures 60, having a diameter D, were drilled into the plastic tube at various heights which correspond to a dimension C, i.e., the offset distance between the liquid dispensing opening A and the top of the vent aperture D. Also, the vent aperture D was formed with several different diameters.

In one set of tests, the container had a height H of approximately 10 inches and a diameter W of approximately 1 inch. A total of sixteen small diameter vent apertures D were drilled, each at 0.100 inch spacing from the bottom end of the container. To provide sufficient distance between each test aperture, the sixteen vent apertures were located along a spiral path around the external diameter of the tube so that each vent diameter could be drilled to a larger diameter. The vent holes initially were all of the same 0.025 inch diameter. All sixteen holes were covered to form an airtight seal. The container of FIG. 9 was filled with water. The apparatus was oriented with the dispensing opening A at the bottom as illustrated in FIG. 9. No liquid was then being dispensed through the opening A. Next, each vent D was exposed one at a time from the bottom up. As the first fifteen vents were exposed to air, no liquid escaped through the dispensing bore A which remained self-sealing by surface tension. When the sixteenth vent was uncovered at a vertical height of about 1.6 inch, venting air began to flow into the interior of the sealed container and water was dispensed through the dispensing bore A. Thus, above a maximum value for C, the vent aperture D would allow air bubbles to flow into the container so that the container became a pouring-type container which no longer would self-seal by surface tension of liquid.

In other tests, the container had a height H of 8.25 inches and a diameter W of 1.0 inch. The dispensing opening had a diameter A of 0.125 inches for one set of tests, and 0.250 inches for another set of tests, and 0.315 inches for further tests. It was determined that the fluid dispensing opening can be varied in diameter A within a range without affecting the self-sealing feature. However, once the diameter A is greater than approximately 0.4 inches, the fluid opening A will self-vent and admit air through the opening A itself. Thus, the primary liquid dispensing opening A preferably should be less than about 0.4 inches in diameter, or less than an equivalent cross-sectional area if the liquid dispensing opening A is irregular in shape.

The term equilibrium means that a flow of liquid will stop in a short time, such as less than one second, after an external disabling force is removed. The term non-pour means that when a container is inverted, with the vent aperture obstructed and also with the vent aperture open, the same amount of liquid will escape the closure before it reaches a static state.

Figure 10:
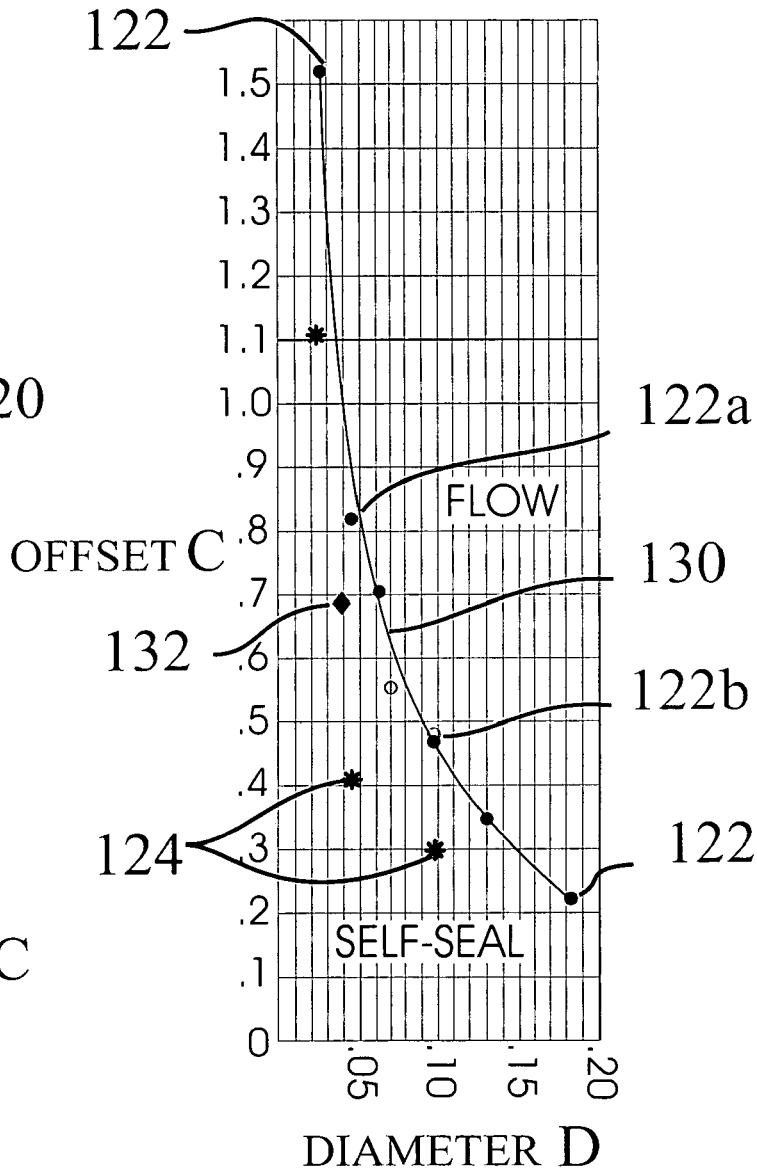
FIG. 10 is a chart showing the results for certain test apparatus and illustrating flow and self-seal characteristics for small aperture vents.

FIG. 10 is a graph which plots the results of several experiments and also illustrates the relationship between the offset C and the diameter D for these experiments. A vertical axis labeled Offset C represents the offset height in inches from the liquid dispensing bore A to the top of the venting aperture D in FIG. 9. A horizontal axis represents the Diameter D in inches of various vent apertures. Each of the dots 122 represent a point of transition between a self-sealing closure versus a flow/pouring type closure for a particular liquid and closure material. For example, point 122*a* shows that a vent aperture D of diameter 0.05 inches was self-sealing by surface tension when located in a desired range from 0 to about 0.82 inches above the liquid dispensing aperture A. When this same vent diameter of 0.05 inches was located by an amount greater than 0.82 inches above the liquid dispensing aperture A, then venting air would enter through the vent aperture D and liquid would flow out of the dispensing opening A. As another example, point 122*b* shows that a vent aperture D of diameter 0.10 inches was self-sealing by surface tension when located in a desired range from 0 to about 0.48 inches above the liquid dispensing aperture A. Two overlapping dots 122*b* are illustrated which represent two different experiments in which the results were essentially the same for water at room temperature. When the vent aperture of diameter 0.10 inches had an offset C greater than about 0.48 inches, the liquid surface tension would rupture and air would undesirably flow through aperture D causing liquid to flow through aperture A.

The points 122 in FIG. 10, which represent the points of transition between a self-sealing closure and a pour closure, are also summarized below in the following Table A. In this Table A, the offset C listed thus represents the maximum length possible to maintain self-sealing by surface tension for each listed vent diameter.

TABLE A

| Vent Diameter | Maximum Offset C | |
|---|---|---|
| D | Liquid 1 | Liquid 2 |
| 0.03 | 1.51 | 1.11 |
| 0.05 | 0.82 | 0.42 |
| 0.06 | 0.70 | |
| 0.07 | 0.55 | |
| 0.10 | 0.48 | 0.29 |
| 0.13 | 0.35 | |
| 0.18 | 0.22 | |

Liquid 1 is water at room temperature, and the resulting plots for dimensions C and D are shown in FIG. 10 by dots 122. Liquid 2 is water with a soap surfactant added to reduce surface tension, and the resulting plots are shown by star symbols 124 in FIG. 10. The weight of soapy liquid which could be supported was reduced by about half or more due to a reduction in surface tension. All dimensions in Table A are given in inches and have been rounded off to the nearest 0.01 inch.

When the different test points for liquid 1 in Table A are plotted, the resulting dots 122 form a curve 130 seen in FIG. 10, which starts somewhat linear for small diameters D and becomes more arcuate for larger diameters D. All intersections above the curve 130 are labeled "flow" because vent apertures of corresponding diameter D and offset C would allow air to continuously bubble through the venting apertures D and cause liquid to flow from the dispensing aperture A. Such a combination effectively creates a pouring dispenser. All intersections below the curve 130 are labeled "self-seal" because vent apertures of corresponding diameter D and offset C would allow the vent apertures D and liquid dispensing aperture A to self-seal by surface tension while the container was at equilibrium. Thus, the many combinations of vent diameters D and offset amounts C located below curve 130 in the "self-seal" region represent the ranges of dimensions to be used to create the novel vented closures of the present invention.

For containers designed to hold other liquids, a plot can be made of test points to produce a curve similar to curve 130 in order to establish the desired combination of vent diameters D and maximum offsets C to create apertures D and A which will self-seal by surface tension for the specific liquid to be stored in the container. Thus, the placement and size of the vent apertures in the base collar can be empirically determined for the liquid to be dispensed. As vent apertures D are moved further away from the dispensing bore A, the diameter or cross-sectional area of each vent aperture must be decreased in order to maintain a self-sealing relationship using the surface tension of the liquid in the container.

The dispensing aperture A and the vent apertures D can have shapes other than circular. The dispensing aperture A can be of irregular shape which can form words and/or symbols. While the vent apertures D can be shapes other than circular, due to their small size, a circular bore is generally easiest to form and manufacture.

To allow for manufacturing tolerances and material variations, it is preferable to select dimensions which are spaced away from the transitional curve 130 which is the dividing line between self-sealing closure and a flow closure. For example, a diamond point 132 is spaced sufficiently away from the transition curve 130 by a desirable amount to self-seal and take into account tolerances and variations which can occur. Thus, the dimensions can be varied provided they plot within the self-seal regions of FIG. 10. For example, it has been found preferable considering human factors and a closure which is within typical commercial standard sizes for the offset height C to be within a predetermined range from about 0.4 to 0.9 inches. Furthermore, a desirable range for the vent diameters is less than 0.10 inches, and preferably from 0.09 to 0.03 inches or an equivalent cross sectional area. Other ranges can be determined following the methodology set forth above. Thus, the relationship which creates the self-sealing action of the vent apertures 60 by surface tension is dependent upon the above considerations. Any closure should be made using dimensions which conform to and create vent openings which self seal by surface tension of the liquid in the container 40.

Figure 11A:
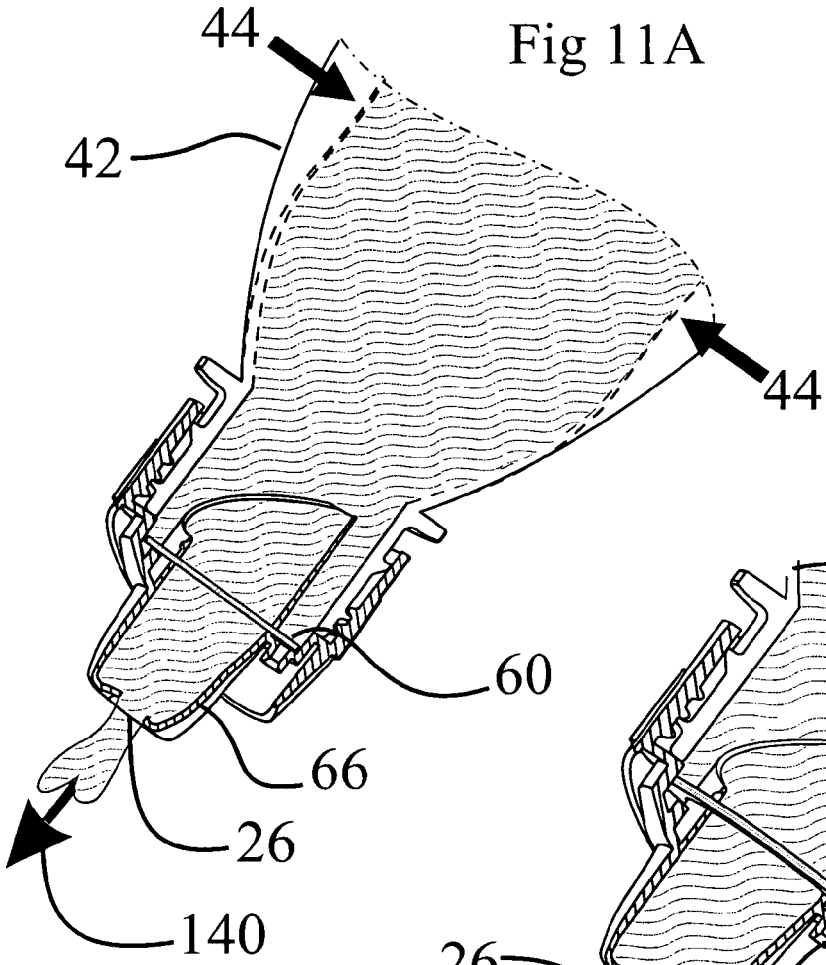
FIGS. 11A, 11B and 11C illustrate the operation of vented dispensing of liquid and self-sealing closure for different conditions of use of the closure.
Figure 11B:
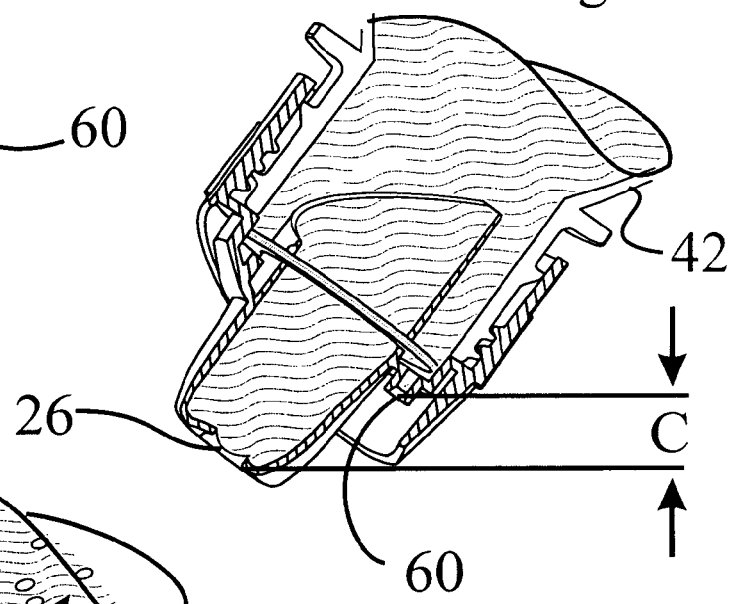
Figure 11C:
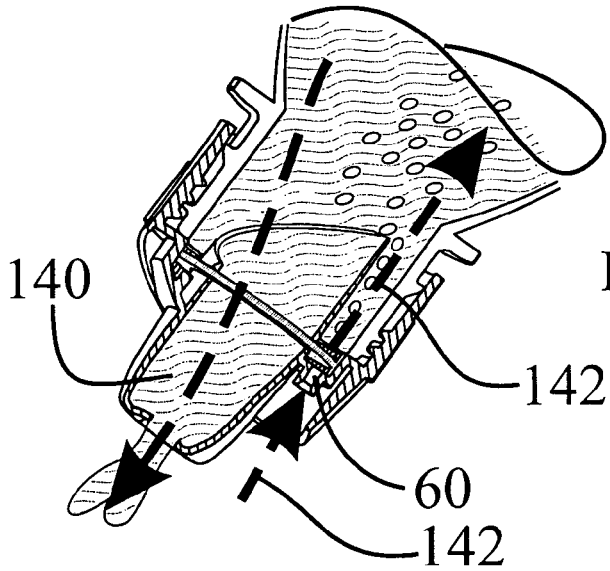

FIGS. 11A, 11B, and 11C illustrate the operation of the present closure under different conditions. In FIG. 11A, the container 42 is tilted and squeezed along direction 44 to cause liquid to flow along the dashed lines 140 and exit the main liquid dispensing opening 26. When the squeezing ceases, the liquid flow ceases in a short period and flow through the main opening 26 and vent openings 60 will cease as illustrated in FIG. 11B.

When the closure and container are tilted as shown in FIG. 11B, the effective column height of liquid between vent aperture 60 and dispensing aperture 26 increases. The offset C shown in FIG. 11B represents the distance or height between the top of the vent aperture 60 when in contact with fluid in the secondary fluid passageway and the bottom of the primary fluid passageway opening 26. Offset C represents the hypotenuse of a triangle having a fixed dimension as one side with a variable dimension C being dependent on the angle of tilt of the closure and container. An additional column of liquid is above the vent aperture 60, as well as above the dispensing aperture 26, but is supported by a partial vacuum at the upper portion of the tilted container. When formed to be self-sealing following the teachings explained earlier, the potential energy of the liquid column C with a diameter of D is insufficient to overcome the coefficient of surface tension which seals the vent opening 60. Thus, when at equilibrium as illustrated in FIG. 11B, liquid within the tilted container does not escape through the primary dispensing aperture 26 which is retained by a pressure differential, nor does equalizing air enter through the vent aperture 60 which is self-sealed by surface tension.

As a pressure differential is created by a user placing his or her mouth over the mouthpiece 66 and sucking to create a vacuum, liquid in the tilted container will flow in a squirt or burst through the primary fluid passageway and along the direction of the dashed line/arrow 140 in FIG. 11C. At the same time, venting air will pass along the dashed lines 142 from outside the cap, through the vent apertures 60 and into the secondary liquid passageway. The resulting air bubbles, which are not to scale, will travel through the liquid in the secondary fluid passageway and into the container to vent the container to external air.

Liquid will continue to be dispersed from the container and venting air will continue to flow into the container as seen in FIG. 11C until the external destabilizing force (sucking on the mouthpiece or squeezing the bottle) ceases. After a short time such as one second or so after removal of the destabilizing force, equilibrium will be established and conditions will return to the steady state condition illustrated in FIG. 11B. That is, the surface tension of liquid will self-seal the vent apertures 60, and the liquid in the container will be retained by a pressure differential after a small amount of liquid passes through opening 26 without being equalized by venting air. Thus, the passage of liquid and air through the apertures will cease even though those apertures remain open. To overcome this equilibrium or steady state condition, the user needs to again create an external destabilizing force which overcomes the surface tension of liquid at the aperture 60 and the pressure differential at the opening 26.

As the offset length C increases, the cross-sectional area of the vent openings 60 must decrease in order to maintain self-sealing by surface tension of the liquid. The vent apertures 60 could be located, for example, on a surface further from the main opening 26, but this requires a very small diameter vent aperture 60 in order to maintain a self-sealing relationship. A very small diameter opening is more apt to be blocked by dust, dirt and other conditions. Conversely, the vent apertures 60 could be located on a surface closer to the main opening 26 but this would increase the likelihood of the vents being covered by the users lips. The location illustrated in the drawings provides a good balance between the size and location of the air vent 60 while maintaining the desired self-sealing properties.

The present invention has been described in an illustrative manner. It should be understood that modifications may be made to the specific embodiments shown herein without departing the spirit and scope of the present invention. Such modifications are considered to be within the scope of the present invention.

What is claimed is:

1. A vented closure for allowing a user to repeatedly drink liquid from a container, comprising:

a base collar engagable with the container and having an upright mouthpiece with an outlet aperture to dispense the liquid from the container, the collar including at least one vent aperture of a small size, a primary fluid passageway extending from the outlet aperture and through the base collar to an interior of the container for conveying the liquid to the outlet aperture, a secondary fluid passageway at least partly separate from the primary fluid passageway and extending from the vent aperture to the interior of the container for conveying venting air into the interior of the container, a cap having a closed position which partly covers the collar and blocks at least the outlet aperture to prevent dispensing of the liquid, a hinge or pivot movably connecting the collar and cap to allow the cap to move about one side of the collar to an open position along an axis which intersects the hinge or pivot and away from the mouthpiece, the collar including a wall located generally opposite the one side which extends upwardly to mate with an edge of the cap when in the closed position, the wall including an offset portion forming a grip area for a user's thumb or finger to move against and flip open the cap to move about the axis to the one side, the grip area being located at an offset angle from the axis which intersects the hinge or pivot, whereby an opening force from the user's thumb or finger is offset from the axis which intersects the hinge or pivot.

2. The vented closure of claim 1 wherein the offset angle is an acute angle less than 90 degrees from the axis which intersects the hinge or pivot to thereby flip the cap open at an acute angle to the grip area.

3. The vented closure of claim 2 wherein the offset angle is from about 30 degrees to about 60 degrees from the axis which intersects the hinge or pivot.

4. The vented closure of claim 1 wherein the wall of the collar forms a curved portion around at least part of the mouthpiece, the cap has a curved portion which mates against the curved portion of the collar wall when the cap is closed, and the grip area for the user's thumb or finger is recessed inwardly from at least one of the curved portions to thereby avoid protrusions outwardly of the curved portions.

5. The vented closure of claim 1 wherein the wall extends above the hinge or pivot and the hinge or pivot is offset at a lower position than the wall, and the cap is movable about the hinge or pivot to a position which is partly lower than the base collar when the cap is fully open.

6. The vented closure of claim 1 wherein said vent aperture is located on the collar at a distance away from the outlet aperture and seals the vent aperture by surface tension of the liquid while the cap is open to thereby block the vent aperture unless an unbalance force is present.

7. A vented closure for allowing a user to repeatedly drink liquid from a container, comprising:

a base collar engagable with the container and having an upright mouthpiece with an outlet aperture to dispense the liquid from the container, the collar including at least one vent aperture of a small size, a primary fluid passageway extending from the outlet aperture and through the base collar to an interior of the container for conveying the liquid to the outlet aperture, a secondary fluid passageway at least partly separate from the primary fluid passageway and extending from the vent aperture to the interior of the container for conveying venting air into the interior of the container, a cap having a closed position which partly covers the collar and blocks at least the outlet aperture to prevent dispensing of the liquid, a hinge or pivot movably connecting the collar and cap to allow the cap to move about one side of the collar to an open position away from the mouthpiece, the collar including a collar wall located generally opposite the one side which extends upwardly and higher than at the hinge or pivot to mate with an edge of the cap when in the closed position, the collar wall including an angled edge which extends downwardly toward the one side, the edge of the cap having an angled edge which mates with the collar wall angled edge when the cap is closed, whereby the angled edges allow the cap to flip open further away from the mouthpiece.

8. The vented closure of claim 7 wherein said vent aperture is located through a floor portion of the collar in a region adjacent to the collar wall, and the collar wall extends above and covers a portion of the vent aperture to avoid blocking contact with the user's mouth when drinking from the mouthpiece.

9. The vented closure of claim 7 wherein the collar wall includes a recessed grip area for a user's thumb or finger to move against the cap and flip open the cap about the hinge or pivot.

10. A vented closure for allowing a user to repeatedly drink liquid from a container, comprising:

a base collar engagable with the container and having an upright mouthpiece of a generally oval shape and having an outlet aperture to dispense the liquid from the container, the collar including at least one vent aperture of a small size, a primary fluid passageway extending from the outlet aperture and through the base collar to an interior of the container for conveying the liquid to the outlet aperture, a secondary fluid passageway at least partly separate from the primary fluid passageway and extending from the vent aperture to the interior of the container for conveying venting air into the interior of the container, a cap having a closed position which partly covers the collar and blocks at least the outlet aperture to prevent dispensing of the liquid, a hinge or pivot movably connecting the collar and the cap to allow the cap to move about one side of the collar to an open position away from the mouthpiece, the generally oval shape of the mouthpiece being elongated along a major axis with a pair of opposite wide sides, the mouthpiece major axis intersecting the hinge or pivot so that the cap when in the open position extents to one side of the mouthpiece and along the mouthpiece major axis.

11. The vented closure of claim 10 wherein the closure includes a grip area for a user's thumb or finger to move against the cap and flip open the cap, the grip area being offset at an acute angle from the mouthpiece major axis.

12. The vented closure of claim 10 wherein the mouthpiece is formed of a hollow tube which extends downwardly to define the primary fluid passageway, the tube includes a diverter wall which at least partly separates the primary fluid passageway from the secondary fluid passageway so that vent air passing through the vent aperture and into the container has reduced intermixing with liquid in the primary fluid passageway.

13. The vented closure of claim 12 wherein the primary fluid passageway extends through a central region of the collar and the secondary fluid passageway is asymmetrically formed and defined by a space between the base collar and the divider.

14. The vented closure of claim 12 wherein a barrier surface is located in the secondary fluid passageway to create a circuitous air path for vent air bubbles being conveyed through the secondary fluid passageway.

15. The vented closure of claim 14 wherein the barrier surface includes a floating ring captured within the secondary fluid passageway and located to force vent air to flow around the ring to thereby create a circuitous air path.

16. The vented closure of claim 14 wherein the barrier surface includes a plurality of ribs which are spaced along and extend into the secondary fluid passageway so as to form portions of non-straight paths for vent air in the secondary fluid passageway.

17. The vented closure of claim 10 wherein the mouthpiece extends upwardly from a floor member, and said vent aperture extends through the floor member and is located to one side of the elongated mouthpiece major axis to allow vent air bubbles to enter into the secondary fluid passageway.

18. The vented closure of claim 17 wherein the collar includes a wall which extends above said vent aperture and is located to block the user's lips from covering the vent aperture when the user's lips contact the wide sides of the mouthpiece.

19. A vented closure for allowing a user to repeatedly drink liquid from a container, comprising:

a base collar engagable with the container and having an upright mouthpiece with an outlet aperture to dispense the liquid from the container, the collar including at least one vent aperture of a small size, a primary fluid passageway extending from the outlet aperture and through the base collar to an interior of the container for conveying the liquid to the outlet aperture, a secondary fluid passageway and extending from the vent aperture to the interior of the container for conveying venting air into the interior of the container, a cap having a closed position which partly covers the collar and blocks at least the outlet aperture to prevent dispensing of the liquid, a hinge or pivot movably connecting the collar and the cap to allow the cap to move about one side of the collar to an open position away from the mouthpiece, the collar having a wall which extends above the vent aperture and located to form a protective barrier above the vent aperture whereby the vent aperture remains open while liquid is dispensed from the mouthpiece.

20. The vented closure of claim 19 wherein the wall adjacent the vent aperture is higher than the collar portion adjacent the hinge or pivot, and the cap includes an angled edge which mates with the wall of the collar when the cap is closed.

21. The vented closure of claim 19 wherein the wall near the vent aperture includes a recessed grip area for a user's thumb or finger to move against the cap and flip open the cap about the one side.

22. The vented closure of claim 21 wherein the hinge or pivot defines an axis for flipping open the cap along a center line normal to the axis, and the recessed grip area being spaced from the center line and located at an acute angle from the center line.

23. The vented closure of claim 19 wherein the mouthpiece has a generally elongated and oval shape with a pair of opposite generally wide sides.

24. The vented closure of claim 23 wherein the mouthpiece is elongated along a major mouthpiece axis, and the closure includes a grip area for a user's thumb or finger to move against the cap and flip open the cap, the grip area being offset at an angle from the major mouthpiece axis.

25. The vented closure of claim 19 wherein the cap includes extending posts which mate with and block the vent aperture when the cap is closed.

26. A vented closure for allowing a user to repeatedly drink liquid from a container, comprising:

a base collar engagable with the container and having an upright mouthpiece formed by a hollow tube having an outlet aperture to dispense liquid from the container and extending through the base collar to at least partly form a primary liquid passageway for conveying liquid from an interior of the container to the outlet aperture, at least one vent aperture of a small size, and a secondary fluid passageway at least partly separate from the primary fluid passageway and extending from the vent aperture to the interior of the container for conveying venting air into the interior of the container, a cap having a closed position which partly covers the collar and blocks at least the outlet aperture to prevent dispensing of the liquid, the cap being movable about an axis at one side of the collar to an open position away from the mouthpiece, the base collar further includes a floating ring captured within the secondary fluid passageway and located to force the venting air to flow around the ring to thereby create a circuitous air path for the venting air.

27. The vented closure of claim 26 wherein the base collar includes a plurality of posts which extend above a floor forming the secondary fluid passageway, and the floating ring is partly supported by the plurality of posts and is movable away from the posts.

28. The vented closure of claim 26 wherein the base collar includes a rib extending into the secondary fluid passageway and the floating ring can abut the rib and is movable away from the rib.

29. The vented closure of claim 26 wherein the hollow tube includes a diverter wall which at least partly separates the primary fluid passageway from the secondary fluid passageway, the small size of the vent aperture causing air bubbles to flow through the hollow tube, and the diverter wall at least partly diverting the air bubbles away from the primary fluid passageway to reduce intermixing of air bubbles with liquid flowing through the primary fluid passageway.

* * * * *